US011382482B2

(12) United States Patent
Shintani et al.

(10) Patent No.: US 11,382,482 B2
(45) Date of Patent: Jul. 12, 2022

(54) CLEANING SHEET

(71) Applicant: DAIO PAPER CORPORATION, Shikokuchuo (JP)

(72) Inventors: Naoki Shintani, Shikokuchuo (JP); Asako Fushimi, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 385 days.

(21) Appl. No.: 16/618,460

(22) PCT Filed: May 23, 2018

(86) PCT No.: PCT/JP2018/019782
§ 371 (c)(1),
(2) Date: Dec. 2, 2019

(87) PCT Pub. No.: WO2018/225509
PCT Pub. Date: Dec. 13, 2018

(65) Prior Publication Data

US 2020/0113401 A1 Apr. 16, 2020

(30) Foreign Application Priority Data

Jun. 9, 2017 (JP) ..... JP2017-114688

(51) Int. Cl.
*A47L 13/16* (2006.01)
*A47L 13/42* (2006.01)

(52) U.S. Cl.
CPC ..... *A47L 13/16* (2013.01); *A47L 13/42* (2013.01)

(58) Field of Classification Search
CPC ..... A47L 13/16; A47L 13/42; A47L 13/20; A47L 13/24; A47L 13/256
See application file for complete search history.

(56) References Cited

U.S. PATENT DOCUMENTS

2007/0128411 A1* 6/2007 Kawai ..... B32B 5/022 428/218

FOREIGN PATENT DOCUMENTS

| | | | |
|---|---|---|---|
| CN | 1126505 | C | 11/2003 |
| CN | 106457751 | A | 2/2017 |
| EP | 0988823 | A2 | 3/2000 |
| EP | 1595490 | A1 | 11/2005 |
| EP | 2443980 | A1 | 4/2012 |
| JP | 2000-93373 | A | 4/2000 |

(Continued)

OTHER PUBLICATIONS

Chinese Office Action dated Aug. 4, 2021 of corresponding application No. 201880036823.6; 9 pgs.

(Continued)

*Primary Examiner* — Shay Karls
(74) *Attorney, Agent, or Firm* — Maier & Maier, PLLC

(57) ABSTRACT

A cleaning sheet that is replaceably attached to a flat head section of a cleaning tool; forms a cleaning surface covering the bottom surface of the head section; is bent along a longitudinal edge of the head section and locked to the upper surface of the head section; and has an embossed section having a sheet compressed in the thickness direction and an uncompressed non-embossed section that are arranged alternately along a bent section bent along the longitudinal edge. As a result, a cleaning sheet can be provided that maintains sheet strength and has excellent collection properties.

15 Claims, 6 Drawing Sheets

(56) References Cited

FOREIGN PATENT DOCUMENTS

| | | | |
|---|---|---|---|
| JP | 2002030557 | A | 1/2002 |
| JP | 2004-208941 | A | 7/2004 |
| JP | 3559533 | B2 | 9/2004 |
| JP | 2007-236863 | A | 9/2007 |
| JP | 2017-6610 | A | 1/2017 |
| WO | 2016194460 | A1 | 12/2016 |

OTHER PUBLICATIONS

Translation of International Search Report dated Aug. 21, 2018 and Written Opinion of corresponding application No. PCT/JP2018/019782; 10 pgs.
Chinese Office Action dated Jun. 4, 2021 of corresponding application No. 201880036823.6; 13 pgs.
Chinese Office Action dated Dec. 1, 2020 of corresponding application No. 201880036823.6; 13 pgs.
Supplementary European Search Report and European Search Opinion dated May 20, 2020 of corresponding application No. EP18813157; 7 pgs.
Japanese Office Action dated Jan. 8, 2019 of corresponding application No. 2017114688; 6 pgs.
Japanese Office Action dated Mar. 26, 2019 of corresponding application No. 2017114688; 4 pgs.
Decision to Grant a Patent dated Jun. 4, 2019 of corresponding application No. 2017114688; 5 pgs.

* cited by examiner

[FIG. 1]
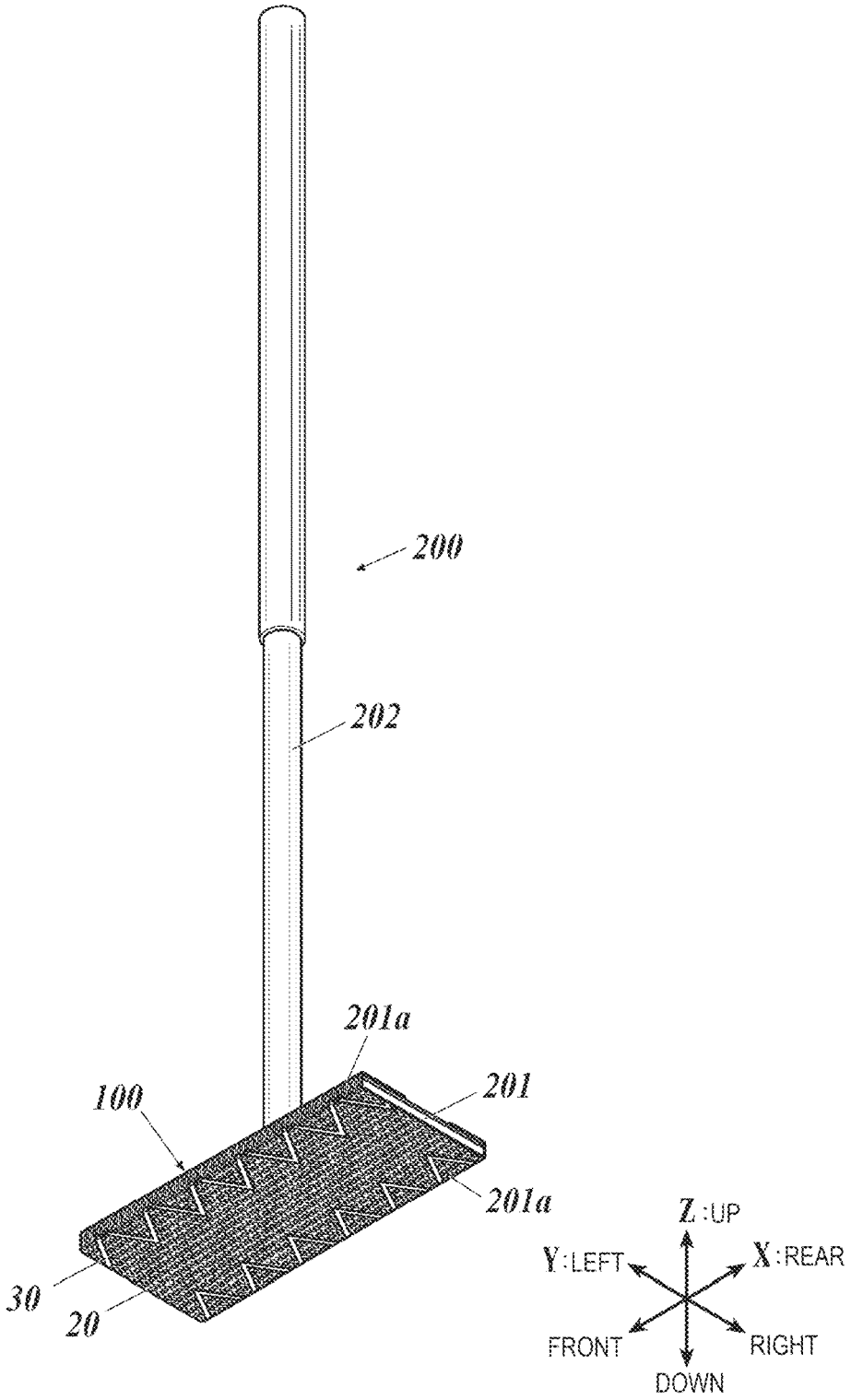

[FIG. 2]
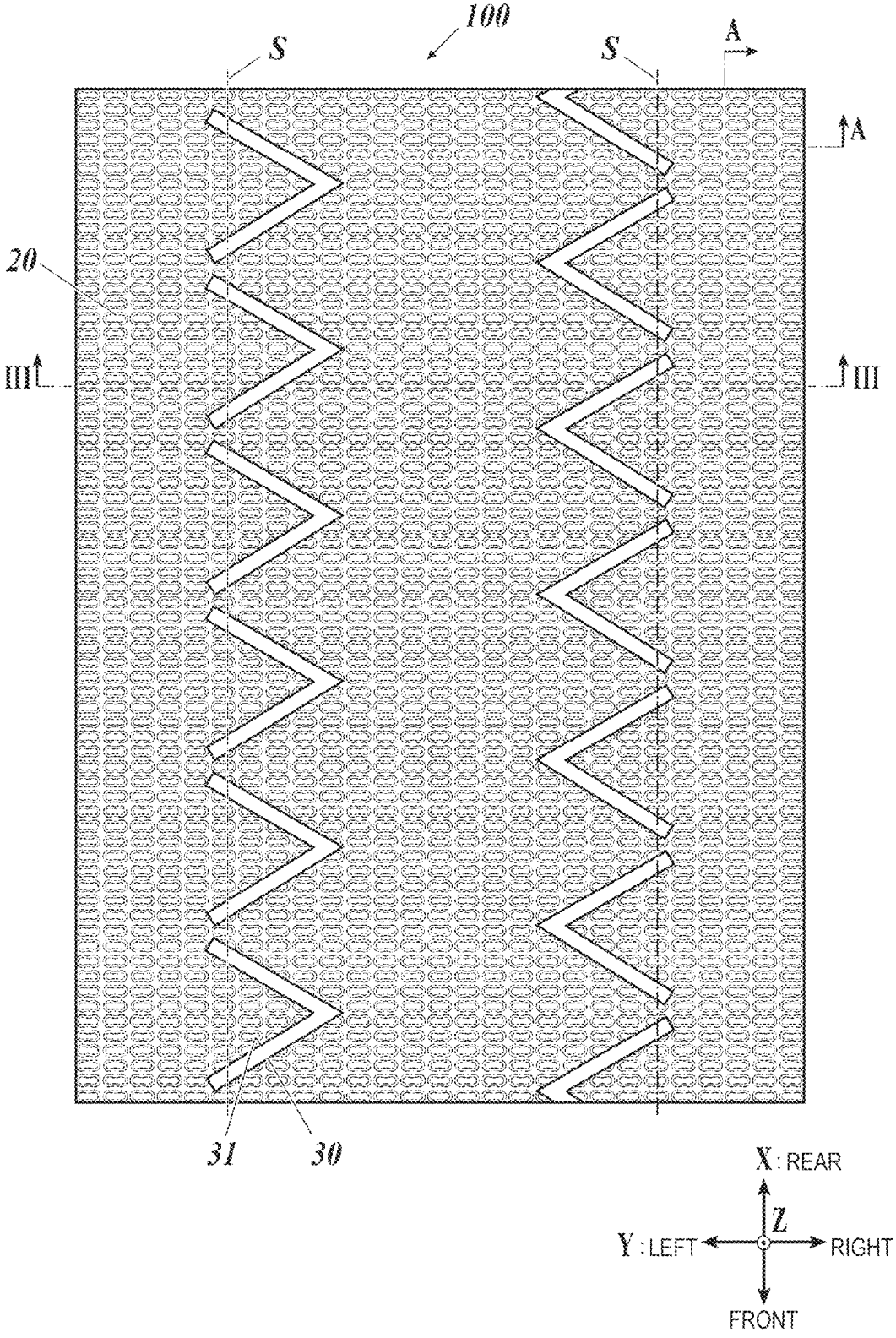

[FIG. 3]
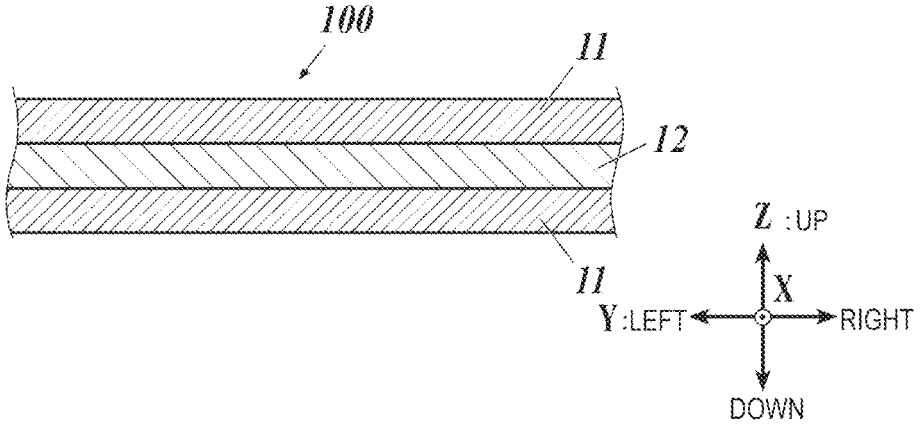
[FIG. 4]
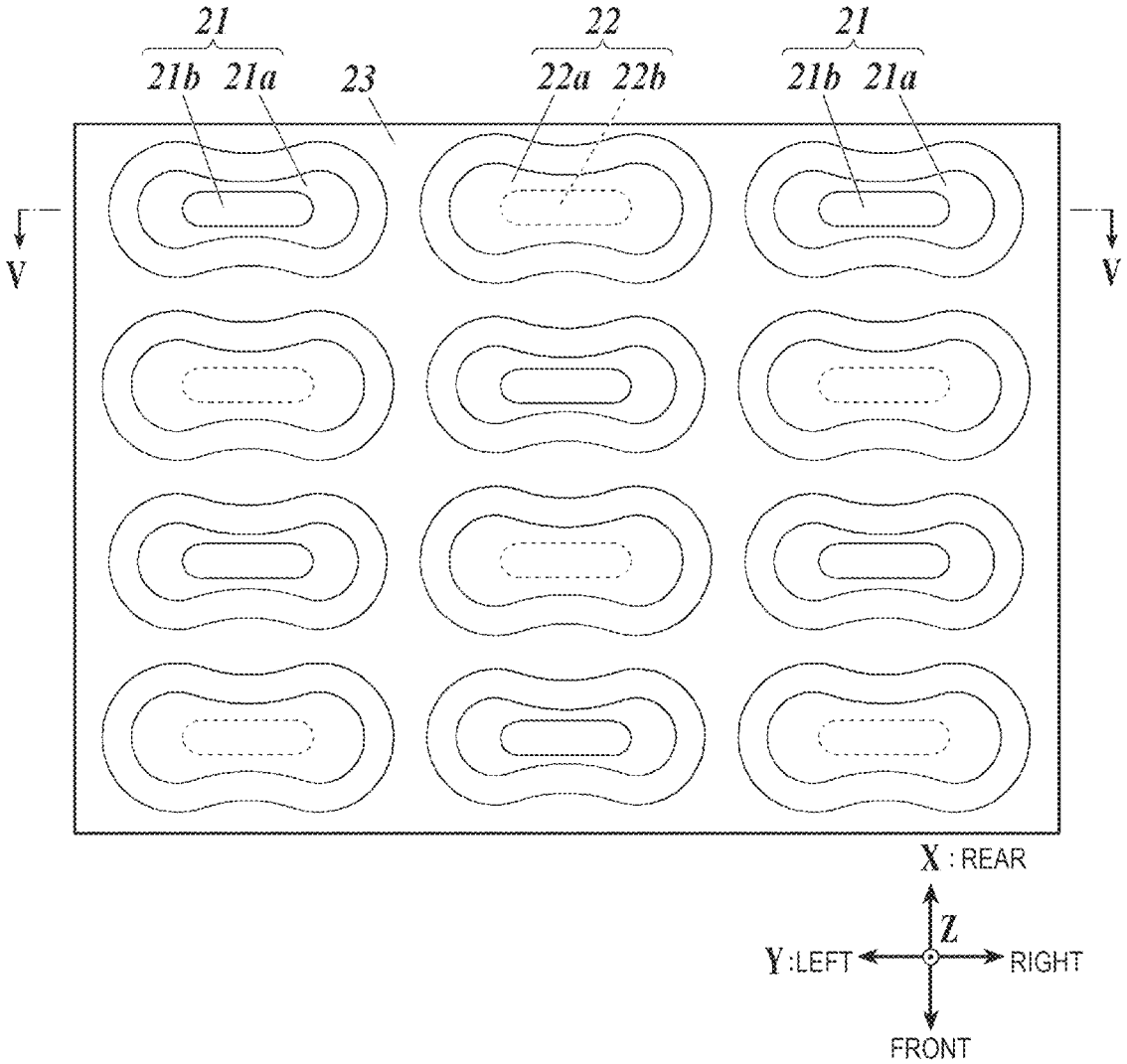

[FIG. 5]
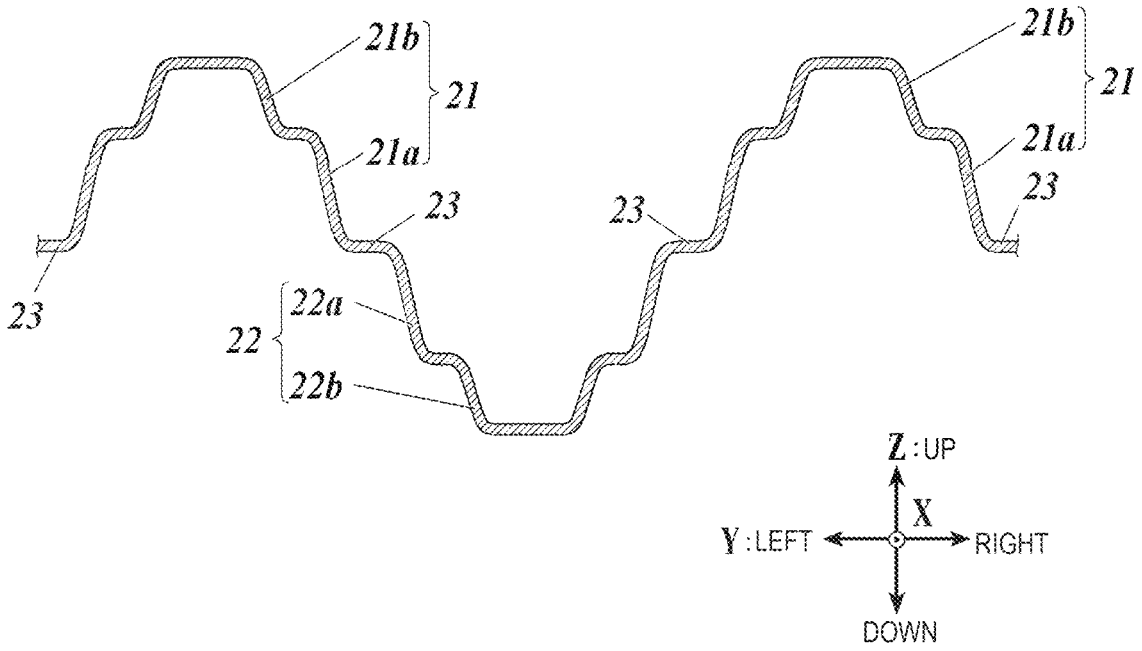

[FIG. 6A]
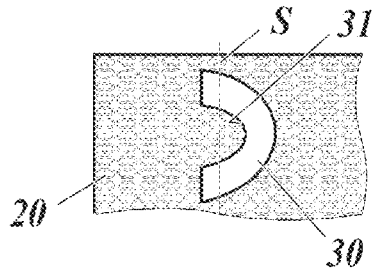
[FIG. 6B]
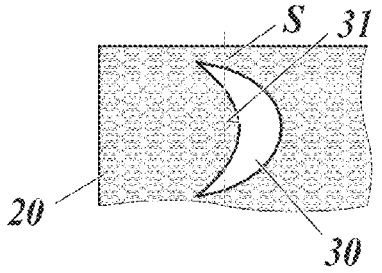
[FIG. 6C]
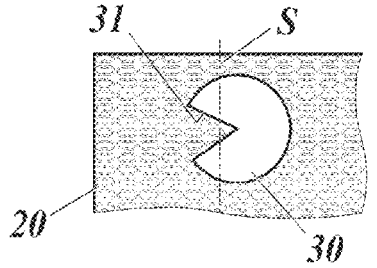
[FIG. 6D]
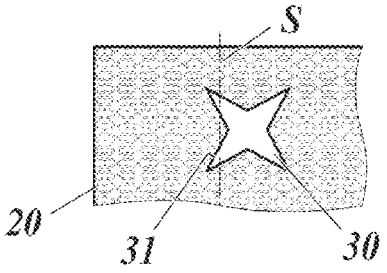

[FIG. 7]
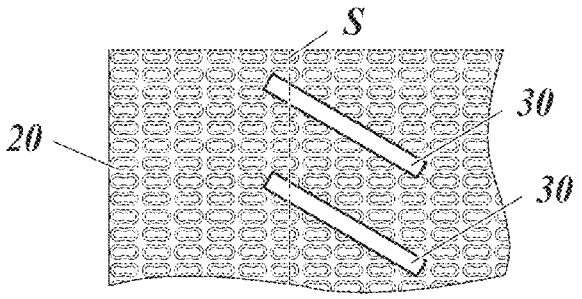

CLEANING SHEET

FIELD

The present invention relates to a cleaning sheet.

BACKGROUND

Conventionally, a cleaning sheet used for cleaning such as cleaning a floor surface is formed in raised and sunken shapes with various patterns in order to increase volume, improve its thickness, reduce frictional resistance and improve dust collection properties.

For example, Patent Literature 1 describes forming the raised and sunken shapes by providing a V-shaped low-density area in a sheet fiber.

Patent Literature 1: Japanese Patent Publication No. 3,559,533

SUMMARY

According to the technique of Patent Literature 1, since the strength of the sheet is reduced due to the low-density area, the sheet may be twisted and torn during cleaning and therefore, collection properties may be degraded.

The object of the present invention is to provide the cleaning sheet which exhibits excellent collection properties while maintaining the strength of the sheet.

The embodiments herein disclose a cleaning sheet that is replaceably attached to a flat cleaning tool forming a cleaning surface covering the bottom surface of the cleaning tool, locked to the upper surface of the cleaning tool by bending along longitudinal edge sections of the cleaning tool, and having embossed sections compressed in the thickness direction and uncompressed non-embossed sections that embossed sections and non-embossed sections are arranged alternately along bent sections folding along the longitudinal edge sections.

According to the embodiments, it is possible to provide the cleaning sheet which exhibits excellent collection properties while maintaining the strength of the sheet.

The embodiments herein further disclose that the multiple non-embossed sections are arranged at predetermined intervals along the bent sections.

According to the embodiments, it is possible to further improve the collection properties.

The embodiments herein further disclose that each of the non-embossed sections is configured having opened sunken part with respect to the longitudinal edge sections of the cleaning tool when attached to the cleaning tool.

According to the embodiments, it is possible to further improve the collection properties.

The embodiments herein further disclose that each of the non-embossed sections is configured extending in the diagonal direction with respect to the longitudinal edge sections of the cleaning tool when attached to the cleaning tool.

According to the embodiments, it is possible to further improve the collection properties.

The embodiments herein further disclose that the non-embossed sections arranged along the bent section corresponding to one of the longitudinal edge sections of the cleaning tool and the non-embossed sections arranged along the bent section corresponding to the other longitudinal edge sections of the cleaning tool are arranged in the different positions with respect to the extending direction of the bent sections.

According to the embodiments, it is possible to further improve the collection properties.

The embodiments herein further disclose that the embossed section includes a first raised part projecting from the sheet surface and a second raised part projecting from the top portion of the first raised part.

According to the embodiments, it is possible to further improve the collection properties.

According to the present invention, it is possible to provide the cleaning sheet which exhibits excellent collection properties while maintaining the strength of the sheet.

BRIEF DESCRIPTION OF THE DRAWINGS

FIG. 1 is a view showing a state of using a cleaning sheet of the embodiment.

FIG. 2 is a plan view showing an example of the cleaning sheet.

FIG. 3 is a cross-sectional view taken along a line III-III of FIG. 2.

FIG. 4 is an enlarged view of a portion A in FIG. 2.

FIG. 5 is a cross-sectional view taken along a line V-V in FIG. 4.

FIG. 6A is a view showing a modified example of a non-embossed section.

FIG. 6B is a view showing the modified example of the non-embossed section.

FIG. 6C is a view showing the modified example of the non-embossed section.

FIG. 6D is a view showing the modified example of the non-embossed section.

FIG. 7 is a view showing the modified example of the non-embossed section.

DETAILED DESCRIPTION

Hereinafter, detailed aspects of a cleaning sheet 100 according to an embodiment of the invention is described while referring to FIGS. 1 to 5. However, the technical scope of the invention is not limited to illustrated examples.

For convenience, as shown in FIGS. 1 to 5, X direction, Y direction, Z direction, front and rear, left and right and up and down are defined and described.

Structure of Embodiment

FIG. 1 is a view showing a state of using a cleaning sheet 100 of the embodiment.

As shown in FIG. 1, the cleaning sheet 100 is a dry sheet exchangeably attached to a cleaning tool 200 including, for example, a rectangular flat head section 201 and a handle section 202 attached to an upper surface of the head section 201.

The cleaning sheet 100 covers a bottom surface of the head section 201 of the cleaning tool 200 to form a cleaning surface and is bent along longitudinal edge sections 201*a* of the head section 201 of the cleaning tool to be locked and attached to the upper surface of the head section 201.

The longitudinal edge sections 201*a* refer to the edge sections in a longitudinal direction of the head section 201. That is, they refer to two long edge sections out of four edges of the rectangular head section 201.

FIG. 2 is a plan view showing an example of the cleaning sheet 100 of the embodiment.

As shown in FIG. 2, the cleaning sheet 100 has a rectangular shape elongated in the X direction and is formed to have a size of, for example, 250 mm to 300 mm, preferably 260 mm to 290 mm in the X direction (the longitudinal direction) and 180 mm to 230 mm, preferably 200 mm to 210 mm in the Y direction (the short direction).

FIG. 3 is a cross-sectional view taken along a line III-III in FIG. 2.

The cleaning sheet 100 is a sheet that a plurality of base papers are layered and has a layer-structure including outer layers 11 and 11 forming surface layers of the cleaning sheet 100 and an inner layer 12 between the outer layers 11 and 11 as shown in FIG. 3, for example.

The outer layer 11 is mainly formed of hydrophobic fibers. Hydrophobic fibers may be chemical fibers mainly containing polyethylene terephthalate, polypropylene, polyethylene or similar chemicals.

The mixing ratio of polyethylene terephthalate fiber for the outer layer 11 is preferably 80% or more and the fiber diameter is preferably 3.3 dtex or more. By setting the fiber diameter to 3.3 dtex or more, rigidity (cushioning property) of the fiber is improved so that it can be operated even with a light force.

Non-woven fabric such as polypropylene spun bond may be used for the inner layer 12. Further, the same hydrophobic fibers as applied for the outer layer 11 may be used and hydrophilic fibers such as pulp, cotton, hemp, rayon or acetate may be appropriately contained.

The sheet structure of the cleaning sheet 100 described above is merely an example, and the number of layers and fibers contained in each layer may be changed as appropriate.

Returning to FIG. 2, in the cleaning sheet 100, sections which are folded along the longitudinal edge sections 201*a* of the head section 201 of the cleaning tool 200 are referred to as bent sections S.

An approximate position of the bent sections S is set in advance in accordance with the head section 201 of the specified cleaning tool 200. That is, two rows of the bent sections S extending in the X direction are set at predetermined positions in the Y direction of the cleaning sheet 100. A straight line corresponding to the bent sections S may be printed on the cleaning sheet 100 or a polygonal line corresponding to the bent sections S may be formed on the cleaning sheet 100 in advance, for example, so that a user can recognize the bent sections S.

Then, a plurality of non-embossed sections 30 are arranged at predetermined intervals in the X direction along the bent sections S of the cleaning sheet 100, and embossed sections 20 are arranged over the entire area except areas in which the non-embossed sections 30 of the cleaning sheet 100.

Thus, the embossed sections 20 and the non-embossed sections 30 are alternately arranged at positions corresponding to the longitudinal edge sections 201*a* of the head section 201 of the cleaning tool 200 in the cleaning sheet 100.

(Embossed Section)

The embossed section 20 is a part of the cleaning sheet 100 in which the sheet is compressed in the thickness direction thereof.

The embossed section 20 may be formed by heat embossing under conditions of a temperature of 80 to 150° C. and an embossing pressure of 0.2 to 1.0 MPa.

FIG. 4 is an enlarged view of a portion A in FIG. 2. Further, FIG. 5 is a cross-sectional view taken along a line V-V in FIG. 4.

As shown in FIGS. 4 and 5, the embossed part 20 is formed with a raised emboss 21 projecting upward (projecting to one surface side of the cleaning sheet 100) and a sunken emboss 22 projecting downward (projecting to the other surface side of the cleaning sheet 100, that is, being recessed).

The raised emboss 21 and the sunken emboss 22 are alternately arranged in both the X and Y directions. By alternately arranging the raised emboss 21 and the sunken emboss 22 regularly as described above, dust collection properties may be improved.

An intermediate section 23 is formed between the raised emboss 21 and the sunken emboss 22 alternately arranged in the embossed section 20. The intermediate section 23 is a portion in which the raised emboss 21 and the sunken emboss 22 are not formed, and thus the intermediate section 23 is positioned lower than the raised emboss 21 and higher than the sunken emboss 22 in the Z direction.

Note that it is not essential to have the embossed pattern described above. Although an effect of improving the dust collection properties may be reduced, an embossed pattern may be such that the raised embosses 21 or the sunken embosses 22 are arranged in a line or irregularly arranged. Further, for example, it may include only either the raised embosses 21 or the sunken embosses 22.

(Raised Emboss)

As shown in FIG. 4, the raised emboss 21 is formed in a so-called gourd shape having a narrow width in the X direction and a constricted portion in a central portion in the Y direction in plan view. Although the configuration describe above is preferable from the viewpoint of dust collection properties, a shape of the raised emboss 21 is not limited and may be formed into various shapes such as a circle, an ellipse, and a polygon. Further, the shapes may be combined.

The raised emboss 21 is formed 2 mm to 5 mm, preferably 3 mm to 4 mm in the X direction, and 5 mm to 10 mm, preferably 6 mm to 8 mm in the Y direction, and 0.5 mm to 2 mm, preferably 0.7 mm to 1.5 mm (height from the intermediate section 23) in the Z direction.

As shown in FIG. 5, the raised emboss 21 is formed in a shape projecting upward in a step-wise manner in a cross-sectional view. That is, in the cross-sectional view, a second raised part 21*b* projecting further upward is formed on a top portion of a first raised part 21*a* projecting from the surface (an upper surface) of the sheet. With such a structure, the cushioning property of the cleaning sheet 100 may be improved.

(Sunken Emboss)

As shown in FIG. 4, the sunken emboss 22 is formed in the so-called gourd shape which is substantially the same shape as the raised emboss 21 in plan view. The shape of the sunken emboss 22 is not limited and may be formed into various shapes or may be a different shape from the raised emboss 21.

Further, as shown in FIG. 5, the sunken emboss 22 is formed in a shape constricted downward in a stepwise manner, which is the shape upside down with the raised emboss 21 in the cross-sectional view. That is, in the cross-sectional view, a second sunken part 22*b* projecting further downward is formed at a top portion of a first sunken part 22*a* projecting from the surface (a lower surface) of the sheet. With such a structure, the cushioning property of the cleaning sheet 100 may be improved.

(Non-Embossed Section)

The non-embossed section 30 is a part of the cleaning sheet 100 in which the sheet is not compressed in the thickness direction but has raised fibers, and the plurality of non-embossed sections 30 are arranged along the rows of the bent sections S of the cleaning sheet 100.

The non-embossed section 30 is formed by designing an embossing roll forming the embossed section 20 so as to exclude the shape of the non-embossed section 30.

The non-embossed section 30 is not limited to a case where compression is not performed at all, but it may be lightly compressed as compared with a portion in which the embossed section 20 is compressed to an extent that the raised fibers remain.

A size of the non-embossed section 30 is formed 40 to 70 mm, preferably 50 to 60 mm in the X direction, and 15 to 70 mm, preferably 20 to 50 mm in the Y direction.

With such setting, when forming a folded line corresponding to the bent section S of the cleaning sheet 100 in production, the folded line can be formed at an appropriate position even when the folded line is meandered by an apparatus.

(Sunken Part)

Each of the non-embossed sections 30 preferably has a shape having a sunken part 31 open to the longitudinal edge section 201*a* of the head section 201 in a state where the cleaning sheet 100 is attached to the cleaning tool 200.

Specifically, for example, as shown in FIG. 2, the non-embossed sections 30 may be formed in a V-shape in plan view, which is open toward the right direction or the left direction, that is, open to a long side from the central portion of the rectangular cleaning sheet 100. That is, if the non-embossed section 30 has the V-shape in plan view, it has a V-shaped sunken part 31.

Thus, when cleaning is performed by moving the cleaning sheet 100 in the Y direction, that is, in a direction parallel to a short side of the cleaning sheet 100, dust is easily accumulated in the sunken part 31 so that the dust collection properties may be further improved.

Further, as shown in FIG. 2, the non-embossed sections 30 are arranged so that positions in the X direction are shifted for each row and alternate with each other. That is, the non-embossed sections 30 along the bent section S corresponding to one of the longitudinal edge sections 201*a* of the head section 201 and the non-embossed sections 30 along the bent section S corresponding to the other longitudinal edge section 201*a* of the head section 201 are arranged at different positions in an extending direction of the bent sections S.

Thus, when cleaning is performed by moving the cleaning sheet 100 in the Y direction, that is, in the direction parallel to the short side of the cleaning sheet 100, the collection properties are mutually complemented, and the non-embossed sections 30 pass through a floor surface without a gap, so that the dust collection properties may be improved.

(Method of Using Cleaning Sheet)

Next, a method of using the cleaning sheet 100 will be described.

In use, the cleaning sheet 100 is attached to the rectangular flat head section 201 of the cleaning tool 200.

Specifically, the head section 201 is placed on the cleaning sheet 100 such that the longitudinal edge sections 201*a* of the head section 201 are aligned with the two rows of the bent sections S extending in the X direction of the cleaning sheet 100. Next, the cleaning sheet 100 is folded along the longitudinal edge sections 201*a* of the head section 201, and both sides of the folded sheet are locked to the upper surface of the head section 201.

Thus, for example, as shown in FIG. 1, the central portion in the Y direction of the cleaning sheet 100 covers the bottom surface of the head section 201 of the cleaning tool 200 to form the cleaning surface, and the embossed sections 20 and the non-embossed sections 30 are alternately arranged in the cleaning sheet 100 at the positions corresponding to the longitudinal edge sections 201 a of the head section 201, that is, along the bent sections S.

In this state, when cleaning is performed by moving the cleaning sheet 100 mainly in the Y direction, that is, in the short direction of the cleaning sheet 100, the embossed sections 20 can scrape fine dust such as sand dust and house dust, and the raised fibers of the non-embossed sections 30 can capture coarse dust such as hair and fiber dust.

More specifically, the coarse dust accumulates in the sunken part 31 of the non-embossed sections 30, and the fine dust can be scraped off by the embossed sections 20 between the non-embossed sections 30 and the embossed sections 20 disposed on the cleaning surface.

The embossed sections 20 is gradually crushed at the second raised section 21*b* and then the first raised section 21*a* (or the second sunken part 22*b* and then the first sunken part 22*a*) with progress of cleaning work, and an area of the cleaning surface is gradually increased. Therefore, it is possible to use it for a long time.

In addition, because the basis weight of each section of the cleaning sheet 100 does not need to be changed in order to form the embossed sections 20 and the non-embossed sections 30, the strength of the cleaning sheet 100 is maintained and therefore, the cleaning sheet 100 will not be twisted or torn during cleaning.

Effect of Embodiment

As described above, the cleaning sheet 100 according to the embodiment is a cleaning sheet attached to the flat head section 201 of the cleaning tool 200 exchangeably, formed the cleaning surface by covering the bottom surface of the head section 201, locked to the upper surface of the head section 201 by bending along the longitudinal edge sections 201*a* of the head section 201, and arranged with the embossed sections 20 compressed in the thickness direction and the uncompressed non-embossed sections 30 alternately along the bent sections S folding along the longitudinal edge sections 201*a*.

Thus, since the basis weights of the embossed sections 20 and the non-embossed sections 30 are the same, the strength of the cleaning sheet 100 is maintained and each section collects the fine dust and coarse dust respectively, and therefore, the dust collection properties may be improved.

Further, according to the embodiment, a plurality of non-embossed sections 30 are arranged at predetermined intervals along the bent sections S.

Thus, the collection area of the coarse dust is formed at predetermined intervals along the longitudinal edge sections 201*a* of the head section 201, and therefore, the dust collection properties may be further improved.

According to the embodiment, each of the non-embossed sections 30 has a shape having a sunken part 31 open to the longitudinal edge section 201*a* of the head section 201 in a state where it is attached to the head section 201.

Thus, dust is easily accumulated in the sunken part 31 so that the dust collection properties may be further improved.

According to the embodiment, the non-embossed section 30 along the bent section S corresponding to one of the longitudinal edge sections 201*a* of the head section 201 and the non-embossed section 30 along the bent section S corresponding to the other longitudinal edge section 201*a* of the head section 201 are arranged at different positions in an extending direction of the bent sections S.

Thus, when moving the head section 201 in the orthogonal direction to the extending direction of the bent sections S, the collection properties of the non-embossed section 30 arranged along the bent section S corresponding to one of the longitudinal edge sections 201*a* of the head section 201 and the non-embossed section 30 arranged along the bent section S corresponding to the other longitudinal edge section 201*a* of the head section 201 are mutually complemented respectively and the dust collection properties may be improved.

According to the embodiment, the embossed section 20 includes the first raised part 21*a* (the first sunken part 22*a*) projecting from the sheet surface and the second raised part 21*b* (the second sunken part 22*b*) further projecting from the top portion of the first raised part 21*a* (the first sunken part 22*a*).

Thus, the embossed section 20 is gradually crushed and the area of the cleaning surface is gradually increased, and therefore, it is possible to maintain the collection properties for a long time.

The present invention is not limited to the embodiment described above, and it is needless to say that the specific structure may be changed as appropriate.

For example, in the embodiment above, the V-shaped non-embossed sections 30 is described as an example, however, the shape of the non-embossed sections 30 is not limited to this as long as it is a shape having the sunken part 31 open to the longitudinal edge section 201*a* of the head section 201 in a state of being attached to the head section 201.

For example, as shown in FIGS. 6A and 6B, it may be a U-shaped non-embossed section 30 having a U-shaped sunken part 31.

In addition, as shown in FIG. 6C, it may be a substantially circular non-embossed section 30 having a V-shaped sunken part 31 formed in a part thereof, or as shown in FIG. 6D, a part of a star-shaped non-embossed section 30 may be used to function as the sunken part 31.

The shape of the non-embossed section 30 is most preferably a shape having the sunken part 31 open to the longitudinal edge section 201*a* of the head section 201 as described above from the viewpoint of collection properties, but as shown in FIG. 7, it may be a shape extending in a direction oblique to the longitudinal edge section 201*a* of the head section 201.

With such a shape, the non-embossed section 30 is disposed obliquely to the longitudinal edge section 201*a* of the head section 201, so that it is possible to collect dust.

In the embodiment above, a case where cleaning is performed by moving the cleaning sheet 100 in the Y direction thereof has been described as an example, however, the non-embossed section 30 may be formed to have a shape open to the short side from the central portion of the rectangular cleaning sheet 100 in consideration of cleaning by moving the cleaning sheet 100 in a direction parallel to the long side of the cleaning sheet 100.

In this case, the cleaning sheet 100 is folded along the short edge sections of the head section 201 (the edge sections along the short direction of the head section 201), and both ends of the folded sheet are locked to the upper surface of the head section 201.

In the embodiment above, the cleaning sheet 100 is described as a dry sheet, however, a wet sheet with a chemical solution may be used. In this case, water retentive layer such as pulp, for example, is preferably used for the inner layer 12.

EXAMPLES

Next, Examples and Comparative Examples of the present invention will be described. Hereinafter, the invention will be specifically described by way of Examples, but the invention is not limited thereto.

<Preparation of Samples>

Example 1

As the outer layer, a non-woven fabric made of 100% hydrophobic fibers containing 80% of polyethylene terephthalate fibers and 20% of core-sheath fibers of polypropylene and polyethylene as binder fibers was prepared. The polyethylene terephthalate fiber having a fineness of 3.3 dtex and the binder fiber having a fineness of 1.7 dtex were used.

As the inner layer, a spun bond non-woven fabric of 100% polypropylene was prepared.

The outer layer and the inner layer described above were entangled by the hydroentangling method to produce the laminated sheet which is a span lace non-woven fabric having a three-layer structure.

The laminated sheet was embossed at a temperature of 105° C. and an embossing pressure of 0.6 MPa to produce a rectangular dry sheet having the embossed section and the non-embossed section as shown in FIG. 2 and was used as the cleaning sheet of Example 1.

The basis weight of the cleaning sheet was 100 gsm, and the measurements of the long side was 300 mm and the short side was 200 mm.

In the embossed section, the gourd-shaped raised emboss and sunken emboss are alternately arranged in both the long side direction and the short side direction, and sizes of the raised emboss and the sunken emboss were both 8 mm in the long side, 3 mm in the short side, and 0.8 mm in height in the projecting direction thereof.

The non-embossed section had the V-shape in plan view, which is open to the long side from the central portion of the cleaning sheet, the entire length in the long side direction of the non-embossed section was 45 mm, and the entire length in the short side direction was 35 mm. A length of the longest part in the long side direction of spaces formed by the sunken part of the non-embossed section was 20 mm. A distance between the non-embossed sections adjacent in the long side direction was 10 mm.

Comparative Example 1

Except changing the shape of the non-embossed section, with respect to the laminated sheet which is the same as Example 1, the dry sheet was produced having the embossed sections and the non-embossed sections by embossing under the same condition and was used as the cleaning sheet of Comparative Example 1.

The shape of the non-embossed section was a square with 10 mm length in the long side and short side directions.

The lengths between the non-embossed sections adjacent in the long side direction are set to be 10 mm and 20 mm which are arranged alternately.

Comparative Example 2

With respect to the entire surface of the laminated sheet which is the same as Example 1, the dry sheet was produced by embossing under the same condition as Example 1 and was used as the cleaning sheet of Comparative Example 2.

Comparative Example 3

The dry sheet of the same laminated sheet as Example 1 was produced without embossing and was used as the cleaning sheet of Comparative Example 3.

<Evaluation of Folded Line>

When processing the folded lines as a guidance for the bent sections of the cleaning sheet of Example 1 and Comparative Example 1, whether or not the folded lines were drawn without shifting from the rows of the non-embossed sections was determined by visual views and evaluated according to the following criteria. The results are shown in Table 1.

Excellent: No shifting

Good: Almost no shifting

Fair: Some shifting

Poor: Shifting

<Evaluation of Fitability>

When attaching the cleaning sheet of Example 1 and Comparative Example 1 to the cleaning tool as shown in FIG. 1, whether or not the edge sections and non-embossed sections of the cleaning tool were fit without shifting from the lines (whether or not the embossed sections and non-embossed sections were arranged alternately along the bent sections folded along the edge sections) was determined by visual views and evaluated according to the following criteria. The results are shown in Table 1.

Excellent: No shifting

Good: Almost no shifting

Fair: Some shifting

Poor: Shifting

<Evaluation of Collection Properties>

Next, with the cleaning sheets of Example 1 and Comparative Examples 1 to 3 attached to the cleaning tool as shown in FIG. 1, the tool was moved in the short side direction of the cleaning sheet for cleaning, and the dust collection properties were evaluated.

The cleaning tool used herein included the head section to which the cleaning sheet was attached and the handle section as shown in FIG. 1.

The head section was configured by attaching a top surface portion and a bottom surface portion, the top surface portion had a rectangular shape with a long side of 240 mm and a short side of 95 mm made of ABS resin (acrylonitrile-butadiene-styrene copolymer synthetic resin), and the bottom portion had a rectangular shape with a long side of 248 mm and a short side of 98 mm made of TPE (thermoplastic elastomer) having a hardness of 70°.

A length of the handle section was the length from a coupling portion with the head section to a tip end of a handle cap and was 215 mm.

In addition, under a state where the cleaning sheet of Example 1 was attached by folding along the edge sections of the head section of the cleaning tool in the long side direction, the non-embossed sections and the embossed sections were arranged alternately on the bent sections as the non-embossed sections became 10 mm and the embossed sections became 10 to 20 mm.

Under a state where the cleaning sheet of Comparative Example 1 was attached to the head section of the cleaning tool as the same as the sheet of Example 1, the non-embossed sections and the embossed sections were arranged on the bent sections as the non-embossed sections became 10 mm and the embossed sections became 10 to 20 mm.

It is noted that only embossed sections were arranged on the bent sections for the cleaning sheet of Comparative Example 2 and only non-embossed sections were arranged on the bent sections for the cleaning sheet of Comparative Example 3.

Criteria for evaluation are as follows. The results are shown in Table 1.

Excellent: Satisfied

Good: Almost satisfied although some dust or the like remained

Fair: Not satisfied much because dust remained

Poor: Not satisfied at all because dust was not collected well

<Comprehensive Evaluation>

Based on the three evaluations, comprehensive evaluation was performed according to the following criteria. The results are shown in Table 1.

Good: Only Excellent or Excellent and Good

Fair: Including one or more Fair

Poor: Including one or more Poor

TABLE 1

| | Folded Line | Fitability | Collection Properties | Comprehensive Evaluation |
|---|---|---|---|---|
| Example 1 | Good | Excellent | Excellent | Good |
| Comparative Example 1 | Fair | Good | Good | Fair |
| Comparative Example 2 | — | — | Fair | Fair |
| Comparative Example 3 | — | — | Poor | Poor |

The results of Table 1 show that the attachment of the sheet of Example 1 to the tool was excellent and the dust collection properties were also excellent.

Even though the dust collection properties of the sheet of Comparative Example 1 at the bent sections are better than samples of Comparative Example 2 and 3, since the dimension of the entire length of the non-embossed sections in the short side direction is short, the sheet of Comparative Example 1 may be shifted when attaching to the tool, and therefore, the non-embossed sections and the embossed sections at the bent sections may not be arranged alternately.

The cleaning sheet with only the embossed sections such as Comparative Example 2 was found to be inefficient for the collection properties at the bent section.

In addition, the collection properties of the cleaning sheet with only the non-embossed sections such as Comparative Example 3 was found to be poor at the bent section. This may be because of the negative influence on the collection properties at the central portion of the head section that the dust may be accumulated at the edges.

The chemical solution was applied to the dry sheets of Example 1 and Comparative Examples 1 to 3 so that an impregnation rate was 270% to produce the wet sheets, and the same evaluation was carried out. The results were the same for the wet sheets.

The present invention is suitable for providing a cleaning sheet used for cleaning a floor surface and others.

The invention claimed is:

1. A cleaning sheet replaceably attached to a flat cleaning tool comprising:

a cleaning surface having a central section covering a bottom surface of the cleaning tool and a pair of bent side sections locked to an upper surface of the cleaning tool by bending the cleaning surface along a pair of bend lines corresponding to a pair of longitudinal edge sections of the cleaning tool;

embossed sections that are compressed in a thickness direction of the cleaning sheet; and non-embossed sections that are not compressed, or compressed less than the embossed sections, in the thickness direction of the cleaning sheet;

wherein the non-embossed sections are arranged only along each of the bend lines.

2. The cleaning sheet according to claim 1, wherein multiple non-embossed sections are arranged at predetermined intervals along the bent sections.

3. The cleaning sheet according to claim 2, wherein each of the non-embossed sections is configured having an opened sunken part with respect to the longitudinal edge sections of the cleaning tool when attached to the cleaning tool.

4. The cleaning sheet according to claim 2, wherein each of the non-embossed sections is configured extending in the diagonal direction with respect to the longitudinal edge sections of the cleaning tool when attached to the cleaning tool.

5. The cleaning sheet according to claim 2, wherein the non-embossed sections arranged along the bend line corresponding to one of the longitudinal edge sections of the cleaning tool and the non-embossed sections arranged along the bend line corresponding to the other longitudinal edge sections of the cleaning tool are arranged in the different positions with respect to the extending direction of the bend lines.

6. The cleaning sheet according to claim 2, wherein each of the embossed sections includes a first raised part projecting from the sheet surface and a second raised part further projecting from the top portion of the first raised part.

7. The cleaning sheet according to claim 1, wherein each of the non-embossed sections is configured having an opened sunken part with respect to the longitudinal edge sections of the cleaning tool when attached to the cleaning tool.

8. The cleaning sheet according to claim 7, wherein the non-embossed sections arranged along the bend line corresponding to one of the longitudinal edge sections of the cleaning tool and the non-embossed sections arranged along the bend line corresponding to the other longitudinal edge sections of the cleaning tool are arranged in the different positions with respect to the extending direction of the bend lines.

9. The cleaning sheet according to claim 7, wherein each of the embossed sections includes a first raised part projecting from the sheet surface and a second raised part further projecting from the top portion of the first raised part.

10. The cleaning sheet according to claim 1, wherein each of the non-embossed sections is configured extending in the diagonal direction with respect to the longitudinal edge sections of the cleaning tool when attached to the cleaning tool.

11. The cleaning sheet according to claim 10, wherein the non-embossed sections arranged along the bend line corresponding to one of the longitudinal edge sections of the cleaning tool and the non-embossed sections arranged along the bend line corresponding to the other longitudinal edge sections of the cleaning tool are arranged in the different positions with respect to the extending direction of the bend lines.

12. The cleaning sheet according to claim 10, wherein each of the embossed sections includes a first raised part projecting from the sheet surface and a second raised part further projecting from the top portion of the first raised part.

13. The cleaning sheet according to claim 1, wherein the non-embossed sections arranged along the bend line corresponding to one of the longitudinal edge sections of the cleaning tool and the non-embossed sections arranged along the bend line corresponding to the other longitudinal edge sections of the cleaning tool are arranged in the different positions with respect to the extending direction of the bend lines.

14. The cleaning sheet according to claim 13, wherein each of the embossed sections includes a first raised part projecting from the sheet surface and a second raised part further projecting from the top portion of the first raised part.

15. The cleaning sheet according to claim 1, wherein each of the embossed sections includes a first raised part projecting from the sheet surface and a second raised part further projecting from the top portion of the first raised part.

* * * * *